United States Patent [19]

Carrieri

[11] 4,214,496

[45] Jul. 29, 1980

[54] SHOCK DAMPENING SYSTEMS FOR PRESSES

[75] Inventor: Louis F. Carrieri, LaGrange Park, Ill.

[73] Assignee: Gulf & Western Manufacturing Company, Southfield, Mich.

[21] Appl. No.: 949,273

[22] Filed: Oct. 6, 1978

Related U.S. Application Data

[63] Continuation-in-part of Ser. No. 765,981, Feb. 7, 1977, abandoned.

[51] Int. Cl.[2] ..... B26D 5/12

[52] U.S. Cl. ..... 83/617; 83/639; 83/13; 83/630

[58] Field of Search ..... 83/617, 615, 630, 639, 83/13

[56] References Cited

U.S. PATENT DOCUMENTS

| | | | |
|---|---|---|---|
| 2,278,713 | 4/1942 | Riddle . | |
| 2,981,136 | 4/1961 | Legge | 83/632 |
| 3,205,749 | 9/1965 | Schenk | 83/639 |
| 3,487,736 | 1/1970 | Kaiser et al. | 83/13 |
| 3,827,323 | 8/1974 | LaFlamme et al. | 83/617 |
| 3,990,351 | 11/1976 | Sundin | 83/639 |
| 4,026,192 | 5/1977 | Noren et al. | 83/617 |

*Primary Examiner*—Donald R. Schran
*Attorney, Agent, or Firm*—Meyer, Tilberry

[57] ABSTRACT

A hydraulic fluid shock dampening system is disclosed for a shearing press to minimize shock and vibration imposed on the press following breakthrough of the material being sheared by cutting die components carried by the press bed and slide. The system includes cylinder and piston units interposed between the press bed and slide each providing a variable volume fluid receiving chamber from which fluid under pressure is expelled during movement of the slide toward the bed to achieve a shearing operation. A flow sensitive shutoff valve is responsive to accelerated movement of the slide upon breakthrough to block fluid flow from the chambers and thus restrain further slide movement toward the press bed. In preferred structural embodiments of the system, the cylinder and piston units, shutoff valve and fluid pressure accumulator components are structurally associated with a bolster plate mountable on a press, or with die components mountable on a bolster plate.

68 Claims, 15 Drawing Figures

SHOCK DAMPENING SYSTEMS FOR PRESSES

CROSS REFERENCE TO RELATED APPLICATION

This application is a continuation-in-part of application Ser. No. 765,981 filed Feb. 7, 1977, now abandoned.

BACKGROUND OF THE INVENTION

The present invention relates to the art of presses and, more particularly, to hydraulic fluid shock dampening systems and arrangements for a shearing press.

In a shearing press, as is well known, cooperable cutting die or shearing components are mounted on the press slide and bed to achieve cutting or shearing of material therebetween in response to movement of the press slide through the downward portion of its total stroke. Upon engagement of the die component on the slide with the material to be severed a load is placed on the press which progressively increases to a maximum which is reached at the point of breakthrough of the die components with respect to the material therebetween. This load is imposed on the press through the slide, and movement of the slide toward the press bed is restrained during the severing operation. This restraint is removed upon breakthrough, whereupon slide movement toward the press bed is accelerated as a result of the load build up. In the absence of a restraining force with respect to such accelerated movement of the slide, objectional shock loads and vibration forces are set up within the press. Such shock and vibration is detrimental to press life as well as maintenance expenses in connection with component parts of the press. Moreover, these shock and vibration forces result in objectionably high noise levels and impart undesirable vibration to other equipment and to the personnel working in the vicinity of the press. Moreover, it will be appreciated that these undesirable characteristics are repeated with each stroke of the press and are related in degree of objectionability to the size of the press.

Efforts have been made heretofore to dampen such shock and vibration forces experienced with the operation of a shearing press. While some success has been achieved in connection with reducing shock and vibration, the systems heretofore proposed for this purpose do not provide optimum efficiency with regard to vibration and noise abatement over a desirable period of continuous use of a given press. Additionally, systems heretofore proposed have characteristics which are detrimental to press life and economical press operation. With regard to such prior art efforts, it has been proposed, for example, to employ a hydraulic shock absorbing system including one or more piston and cylinder units interposed between the press bed and slide to define chambers receiving hydraulic fluid under pressure. During movement of the slide toward the bed to achieve a shearing operation fluid is expelled from the chamber or chambers through a variable restricted passageway incorporated in the piston component and adjusted to provide a predetermined restriction to flow from the chamber at the point of breakthrough of the material being severed. Such a system enables continuous, though restricted, movement of the slide following breakthrough and, thus, the imposition of some shock and vibration forces on the press. Moreover, if two or more such piston and cylinder units are employed in a given press, the adjustment thereof must be extremely accurate to avoid eccentric loading of the slide as a result of different pressure drops across the restrictions of the different units. Still further, the accuracies required in these units makes the system extremely expensive, and continuous operation of the press results in a requirement for frequent adjustment of the units whereby down time of the press is undesirably high as is maintenance time and expense. Additionally, continuous operation of the press with continuous flow of hydraulic fluid from the cylinder chambers each time the slide strokes results in undesirably high fluid temperatures which may necessitate the use of a cooling system therefor, thus adding to the cost of production and expensive operation of the press. Still further, even if just one piston and cylinder unit is employed to avoid the possibility of eccentric loading of the slide, the accuracy required with regard to adjusting the point of maximum restriction to coincide with the point of material breakthrough is impractical.

Other systems heretofore proposed have included a fixed orifice in the hydraulic system operable to pass hydraulic fluid from a fluid receiving chamber to a tank or the like by a low pressure drop during initial cutting of the material and at a high pressure drop when breakthrough occurs. The high pressure drop provides a restraining force against the slide. Systems of the latter character have poor efficiency with regard to reducing shock and noise and, additionally, generate excessive heat in the fluid due to the substantially continuous flow thereof under pressure.

With further regard to hydraulic shock dampening systems for shearing presses, the structural arrangements heretofore provided have been designed for a given press and, at least to some extent, have required certain component parts of the system to be a part of the physical structure of the press for which the system is designed. Still further, while such systems may include a piston and cylinder arrangement between the slide and bed of the press, the hydraulic circuitry associated therewith including, for example, high pressure responsive safety devices, flow control valves, hydraulic fluid accumulators and the like are mounted on or adjacent the press and thus are structurally separate from the piston and cylinder units and/or the mounting thereof on the press and are operatively associated therewith through long fluid flow lines therebetween. Such prior structural arrangements limit the capabilities of a given press from the standpoint of modification of the shock dampening system in accordance with work to be performed by the press. Additionally, such prior structural arrangements at least for practical purposes are not interchangeable such that at least a major portion of the system can be readily disassembled from one press and mounted on another, or such that tooling for a particular metal cutting operation and having a major portion of the shock dampening system components structurally associated therewith could be selectively employed with any one of a number of different presses.

In accordance with the present invention, the disadvantages of previous shock dampening systems provided in connection with shearing presses, including those specifically enumerated hereinabove, are minimized or overcome. In this respect, with regard to one aspect of the invention, maximum restraint of slide movement following breakthrough is achieved by quickly and positively blocking fluid flow from hydraulic fluid receiving chambers interposed between the press slide and bed. This maximum restraining force provides increased efficiency in reducing shock and noise by minimizing the load energy released and thus slide movement following breakthrough. Moreover, by positively blocking fluid flow from the chamber or chambers there is very little heat generated in the system fluid. Accordingly, the necessity of cooling systems are avoided as is the danger of excessive heat in the system without such a cooling system.

Preferably, such shutoff of fluid flow from a fluid chamber at the point of breakthrough is achieved by a flow sensitive valve in the fluid system which is responsive to acceleration of the slide at the point of breakthrough to block fluid flow from the chamber or chambers. Further, the shock and vibration loads imposed on the press by energy release at breakthrough can be further reduced by using a minimum volume of hydraulic fluid in the system, by using a fluid having a high bulk modulus, and and by rapid response of the flow sensitive valve. Preferably, the flow sensitive shutoff valve provides restricted flow from the chamber or chambers with minimal pressure drop during the cutting operation up to the point of breakthrough. At the point of breakthrough, acceleration of the slide positively shuts the valve producing a rapid counterload against slide movement, thus reducing the energy release experienced at breakthrough and maintaining the load on the press through the slide, thus to minimize shock, vibration and noise.

In accordance with another aspect of the invention, the hydraulic fluid receiving chambers of a shock dampening system are structurally incorporated in a bolster plate or a tooling assembly removably mountable on the press bed, thus enabling interchangeability thereof with a number of different presses and facilitating maintenance thereof without requiring shut down of the press for this purpose. Such a structural arrangement further facilitates designing a system for a given tooling assembly to provide a structural unit which can be readily assembled and disassembled for use with any one of a number of different presses. Preferably, components for controlling the flow of fluid from the hydraulic fluid receiving chamber such as the shutoff valve referred to hereinabove and fluid pressure responsive relief devices such as accumulators are structurally incorporated in the bolster plate or tooling assembly for mounting and removal from the press therewith. Fluid flow communication between the components of such a structural unit is provided in part by passageways provided in the bolster plate or components of the tooling assembly adapted to be connected to the source of hydraulic fluid under pressure. Accordingly, when the structural unit is mounted on the press bed it is only necessary to connect such a passageway or passageways with the hydraulic fluid source to prepare the shock dampening system for use. Likewise, when removal of the structural unit is desired, it is only necessary to disconnect the hydraulic fluid supply lines and then dismount the structural unit from the press bed. Accordingly, in addition to the interchangeability provided by such a structural unit, a minimum amount of time and effort is required to mount and dismount the unit with respect to a given press. Moreover, it will be appreciated that such a structural unit facilitates the performace of maintenance on the component parts thereof, and that the interchangeability provides economical advantages through use of a given unit with different presses.

It is accordingly an outstanding object of the present invention to provide an improved hydraulic shock dampening system for shearing presses.

Another object is the provision of a shock dampening system of the foregoing character which minimizes energy release, with respect to the load on the press, upon breakthrough of the material being severed.

Yet another object is the provision of a shock dampening system of the foregoing character which efficiently minimizes the imposition of shock and vibration forces on a press and the resultant noise level of the press during shearing operations.

Still a further object is the provision of a shock dampening system of the foregoing character which positively blocks fluid flow from an expansible chamber unit interposed between the press slide and bed at breakthrough of the material being severed, thus to minimize energy release with respect to the slide at the point of breakthrough and maximize slide restraining force.

Yet another object is the provision of a shock dampening system of the foregoing character in which a flow sensitive valve is employed to permit restricted flow of hydraulic fluid from the expansible chamber device during cutting of material up to the point of breakthrough and which is responsive to acceleration of the slide at the point of breakthrough to close the valve and thus block further fluid flow from the expansible chamber device.

Still another object is the provision of a shock dampening system of the foregoing character which is inexpensive to manufacture and install and which is highly efficient in operation throughout long periods of continuous use, thus minimizing down time of the press and maintenance time and expense.

A further object is the provision of a hydraulic shock dampening system for a shearing press in which component parts of the system are structurally interrelated as a unit enabling interchangeability thereof between presses.

A further object is the provision of a shock dampening system of the foregoing character in which at least a variable volume fluid receiving chamber and a component for controlling fluid flow therefrom are structurally incorporated either in a bolster plate or a tooling assembly removably mountable on a press bed.

Yet a further object is the provision of a shock dampening system of the foregoing character in which the major components of the system including fluid pressure responsive relief components are structurally associated with the bolster plate for removal therewith as a unit from the press bed to facilitate the performance of maintenance thereon as well as the interchangeability thereof between presses.

Another object is the provision of a shock dampening system of the foregoing character in which components of the system are structurally associated with a tooling arrangement for removal therewith as a unit from a given press, thus enabling the tooling arrangement and its associated shock dampening system components to be interchanged between presses.

Yet another object is the provision of a shock dampening system of the foregoing character in which a bolster plate or tooling components are structurally interrelated with components of the system to provide a structurally compact unit readily mountable and dismountable with respect to a press bed to facilitate maintenance and/or interchangeability and which, when mounted on a press bed, need only be connnected to a source of hydraulic fluid under pressure in preparation for use.

The foregoing objects, and others, will in part be obvious and in part pointed out more fully hereinafter in conjunction with the written description of preferred embodiments of the the invention shown in the accompanying drawings in which.

DESCRIPTION OF PREFERRED EMBODIMENTS

Figure 1:
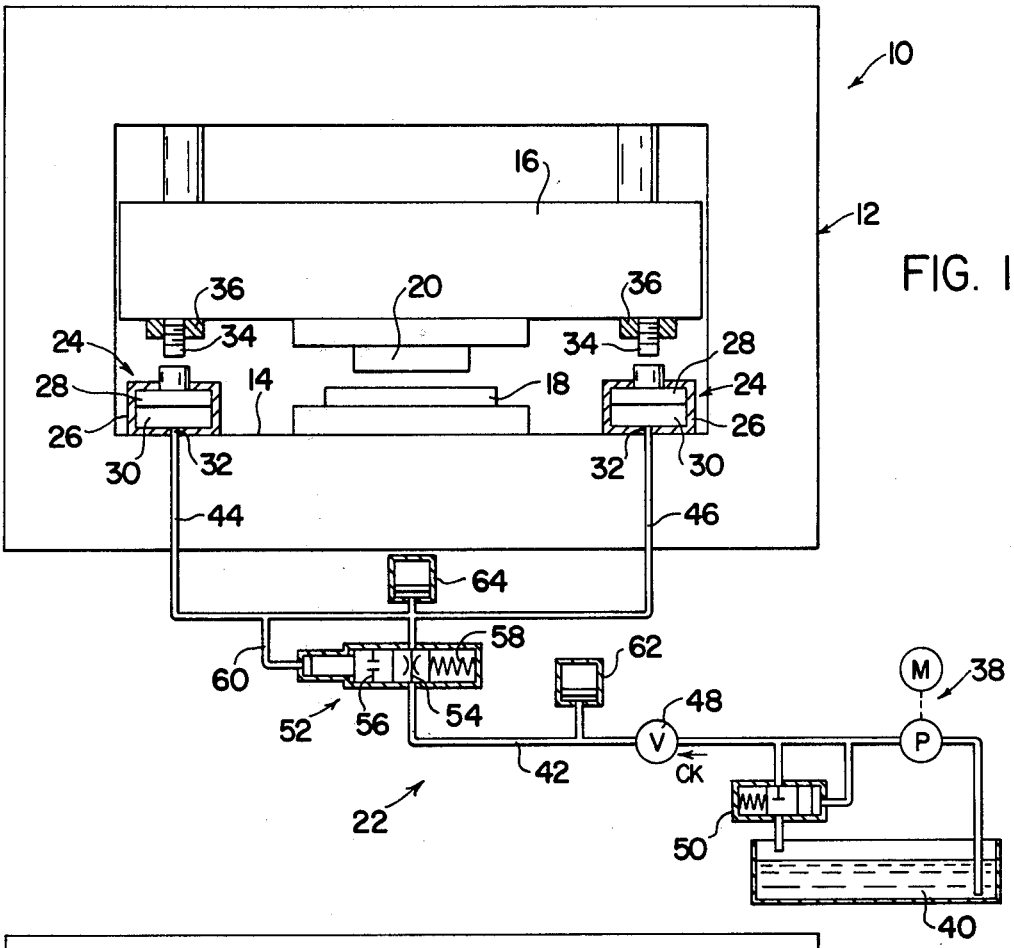
FIG. 1 is a schematic illustration of a shock dampening system in accordance with the present invention associated with the slide and bed components of a shearing press.

Referring now in greater detail to the drawings wherein the showings are for the purpose of illustrating preferred embodiments of the present invention only and not for the purpose of limiting the same, a hydraulic fluid shock dampening system is schematically illustrated in FIG. 1 and in conjunction with a shearing press 10 operable, for example, to cut blanks from metal sheets. The structure and operation of presses of this character are of course well known in the art, and details regarding the structure and operation are not necessary to an understanding of the present invention. It will be sufficient to appreciate that the press has a frame 12 providing a press bed 14 and that the frame supports a slide 16 for reciprocation toward and away from bed 14, a suitable drive arrangement being provided to achieve such reciprocation. As is further well known in the shearing press art, bed 14 supports a shearing component 18 and slide 16 supports a shearing component 20 cooperable with component 18 to cut material therebeneath during downward movement of slide 16 to the bottom dead center position thereof. Cutting takes place, of course, from a point along the slide stroke above the bottom dead center position at which shearing component 20 engages the material to a second point along the slide path just ahead of bottom dead center at which shearing components 18 and 20 cooperatively breakthrough the material being cut. As is well known to those skilled in the art of presses, engagement of material to be cut between shearing components 18 and 20 during downward movement of the slide imposes a load on the press through the slide and which load is suddenly released upon breakthrough of the material, whereupon downward movement of the slide is accelerated in the direction toward the bottom dead center position thereof. This is of course accompanied by release of the energy stored by loading of the press during the shearing operation.

In accordance with the present invention, a shock dampening system is associated with the slide and frame components of the press to minimize downward displacement of the press slide following breakthrough, thus to minimize the release of energy resulting from loading of the press up to the point of breakthrough. The shock dampening system, designated generally by the numeral 22 in FIG. 1, is a hydraulic system including hydraulic fluid receiving variable volume devices 24 mounted on or supported relative to the press bed for actuation by slide 16 during downward movement thereof toward the bottom dead center position. In the embodiment shown, each variable volume device 24 is in the form of a piston-cylinder assembly including a cylinder 26 supported on the press bed and a piston 28 supported within cylinder 26 for vertical reciprocation relative thereto. The space in cylinder 26 behind piston 28 defines a fluid receiving chamber 30, and cylinder 26 is provided with a common inlet and outlet passage 32 opening into chamber 30. Slide 16 carries an actuator pin 34 for each piston, and each pin 34 has its upper end threadedly interengaged with a support collar 36 on the slide so that the pin is vertically adjustable relative to the slide for the purpose set forth hereinafter.

Chambers 30 of variable volume devices 24 are connected to a common source of hydraulic fluid under pressure. More particularly, in the embodiment shown in FIG. 1 a motor-pump unit 38 is adapted to deliver hydraulic fluid under pressure to chambers 30 from a source 40 through a flow line system including a flow line 42 and branch lines 44 and 46 connected thereto and to one of the passageways 32 of variable volume devices 24. A one way check valve 48 prevents backflow to source 40, and a pressure responsive unloading valve 50 is operable at a predetermined pressure between valve 48 and the motor-pump unit to return hydraulic fluid to the source when valve 48 is closed and the pressure between the latter valve and motor-pump unit 38 exceeds the setting of valve 50.

A normally open fluid flow sensitive shutoff valve 52 is provided in flow line 42 to control fluid flow through the latter line. Valve 52 includes a restricted passageway 54 permitting restricted fluid flow in the direction between chambers 30 and source 40 when valve 52 is in the open position illustrated in FIG. 1. Valve 52 further includes a closed passageway 56 which is adapted to block fluid flow through line 42 when valve 52 is in the closed position in which passage 56 would be shifted to the right in FIG. 1 to a position in alignment with flow line 42. Valve 52 is normally biased to the open position such as by a spring 58 and is adapted to be biased to the right in FIG. 1 by fluid under pressure from branch lines 44 and 46 acting thereagainst through a feed line 60, as described in greater detail hereinafter. For the purpose set forth hereinafter, a low pressure hydraulic fluid receiving accumulator 62 is connected to flow line 42 between valves 48 and 52, and a high pressure hydraulic fluid receiving accumulator 64 is connected in fluid communication with line 42 and branch lines 44 and 46 between valve 52 and chambers 30 for variable volume devices 24.

Figure 2:
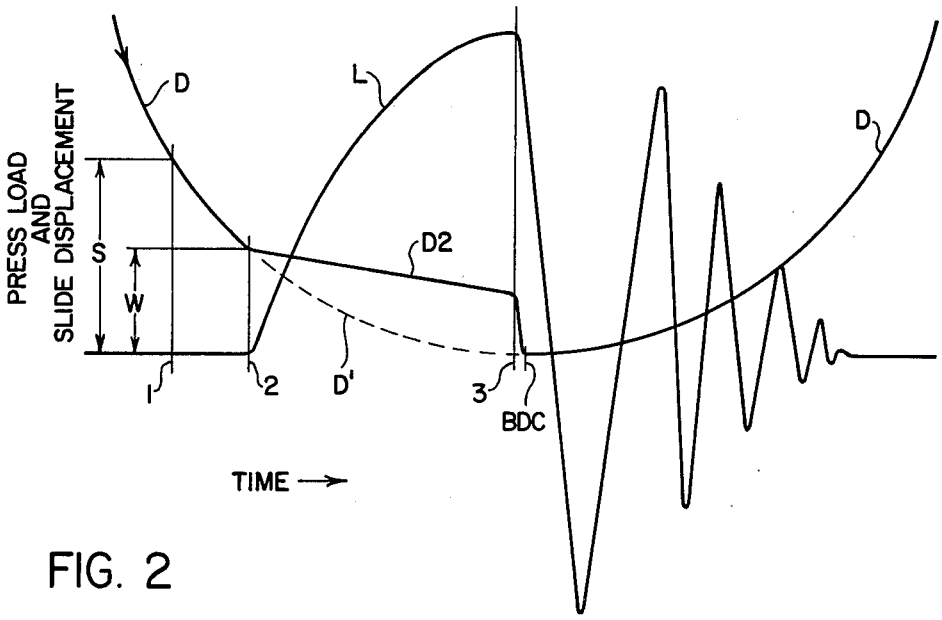
FIG. 2 is a graph showing slide displacement and press load curves during the working stroke of a shearing press without shock dampening.
Figure 3:
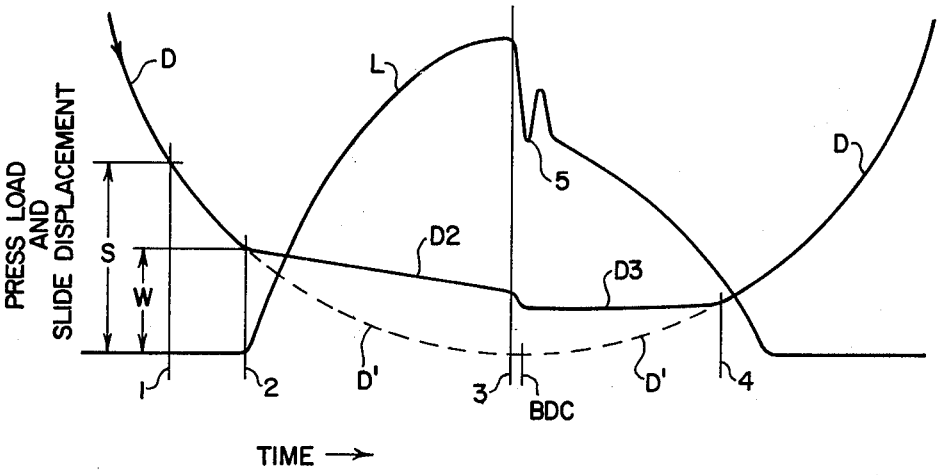
FIG. 3 is a graph showing slide displacement and press load curves during the work stroke of a shearing press having a shock dampening system in accordance with the present invention.

Operation of the shock dampening arrangement described above will be best understood by referring to FIGS. 2 and 3 of the drawing together with FIG. 1. Briefly, FIGS. 2 and 3 are graphs showing slide displacement and press load during movement of the slide through the shearing stroke. FIG. 2 shows the effect of no shock dampening of the slide, and FIG. 3 shows the effect of the shock dampening system described above and the effect of prior art shock dampening systems. In both graphs, the point 1 represents the time during the slide stroke at which, in the system disclosed herein, pins 34 engage pistons 28 during movement of the slide toward the bottom dead center position thereof which is indicated BDC in FIGS. 2 and 3. Point 2 represents the time at which the shearing components engage the material to be severed, and point 3 represents the time at which breakthrough of the material by the shearing components occurs. Curve L represents the load imposed on the press during a severing operation, and curve D represents the position of the slide during the severing operation relative to bottom dead center. If the press was not loaded by the interposition of material to be cut between the shearing components, slide displacement curve D would be arcuate throughout its extent and thus would follow the arcuate portion D′ between point 2 and BDC in FIG. 2 and between points 2 and 4 in FIG. 3. The significance of point 4 is set forth hereinafter.

With regard now to the operation of the shock dampening arrangement described hereinabove, the components of the press and hydraulic system are in the positions illustrated in FIG. 1 prior to a shearing operation. Hydraulic fluid is delivered under pressure from source 40 to chambers 30 through flow line 42, restricted passage 54 of valve 52 and branch lines 44 and 46, and the fluid under pressure in chambers 30 biases pistons 28 upwardly. As slide 16 moves downwardly toward bed 14, pins 34 engage pistons 28 just before shearing components 18 and 20 engage the material therebetween to be severed. The adjustability of pins 34 enables setting the pins in this respect. As mentioned above, the material is engaged at point 1 in the graphs of FIGS. 2 and 3 and at this time the slide is located a distance S above BDC. Continued downward movement of slide 16 causes downward movement of pistons 28 in cylinders 26 thus forcing the hydraulic fluid in chambers 30 into branch lines 44 and 46 through cylinder passages 32. This fluid from chambers 30 flows back toward source 40 through restricted passage 54 of valve 52 and, since one way valve 48 is closed against return of fluid to source 40, accumulator 62 receives the back flow fluid under pressure and stores the latter for return towards chambers 30 as set forth hereinafter. During this movement of the slide toward its bottom dead center position the slide has a normal velocity which is a known factor in connection with a given press, and shutoff valve 52 is structured for this normal velocity to produce a minimal pressure drop through restricted passage 54, whereby the opening bias is sufficient to maintain valve 52 open.

Continued downward movement of slide 16 brings shearing components 18 and 20 into engagement with the material therebetween, thus initiating the imposition of a load on the press through the slide. This engagement with the material is represented by point 2 in the graphs, and at this time the slide is spaced a distance W above the bottom dead center position thereof. As the shearing components cut the material, pins 34 continue to depress pistons 28 and the loading of the press restrains advancement of the slide and reduces the velocity thereof. Accordingly, the piston displacement is gradual causing a continuance of the foregoing fluid flow from chambers 30 through restricted passage 54 of valve 52 to accumulator 62. As will be seen from load curve L in the graphs, the press is loaded from zero to a maximum as the shearing components move through the material during the period of slide displacement represented between points 2 and 3. At the same time, it will be seen that the material between the shearing components restrains displacement of the slide in the downward direction towards bottom dead center, as represented by portion D2 of the displacement curve in the graphs.

The shearing components breakthrough the material at point 3 whereby the load is removed from the press and the stored energy of the load is imposed on the slide causing a rapid acceleration of the slide towards its bottom dead center position. In the absence of any shock dampening of the slide at this point, the slide is immediately accelerated to bottom dead center, thereby imposing shock on the press and bounce of the slide resulting in the imposition of a series of reverse direction loads on the press as indicated by the portion of load curve L to the right of point 3 in FIG. 2.

A shock dampening system in accordance with the present invention advantageously restrains slide displacement toward BDC following breakthrough a minimizes the energy release so as to maintain a load on the press during completion of the severing operation. In this respect, with reference to FIG. 1, acceleration of the slide which occurs upon breakthrough is transmitted to pistons 28, thus suddenly accelerating displacement of the pistons in the direction to reduce the volume of chambers 30. This sudden displacement increases the velocity of the hydraulic fluid flowing from chambers 30, whereby valve 52 is actuated through feed line 60 to close the valve and thus positively block fluid flow from chambers 30. Thus, as seen in FIG. 3, load energy release is stopped at point 5 following breakthrough and the slide is restrained from reaching BDC, as represented by portion D3 of the slide displacement curve. Accordingly, a major portion of the load is maintained on the press following breakthrough. From the point of time in normal slide displacement at which BDC is reached the press load is progressively decreased as a result of movement of the slide drive components which would normally cause upward displacement of the slide from BDC. At point 4 in the graph of FIG. 3, the slide drive components are in slide displacement positions corresponding to the displacement position in which the slide is held by the piston-cylinder units 24. Thereafter, the slide drive components move the slide upwardly and the load on the press is reduced to zero.

The load maintained on the press in this manner maintains the hydraulic fluid between chambers 30 and valve 52 under pressure to maintain valve 52 closed. Upon upward movement of slide 16, the fluid pressure in the system biases pistons 28 upwardly to reduce system pressure and thus provide for spring 58 to open vlave 52. Thereafter, fluid accumulated under pressure in accumulator 62 is released to flow through restricted passage 54 of valve 52 back into branch lines 44 and 46 and chambers 30 to fully bias pistons 28 to their uppermost positions. Motorpump unit 38 is operable to replenish any fluid leakage from the system which might occur during operation of the press.

High pressure accumulator 64 is a safety device to prevent damage as a result of press overload. If, for example, there is some breakdown which causes the press slide to impose a high pressure on the hydraulic system between piston-cylinder units 24 and check valve 48, accumulator 64 is actuated to receive fluid under such excess pressure.

Figure 4:
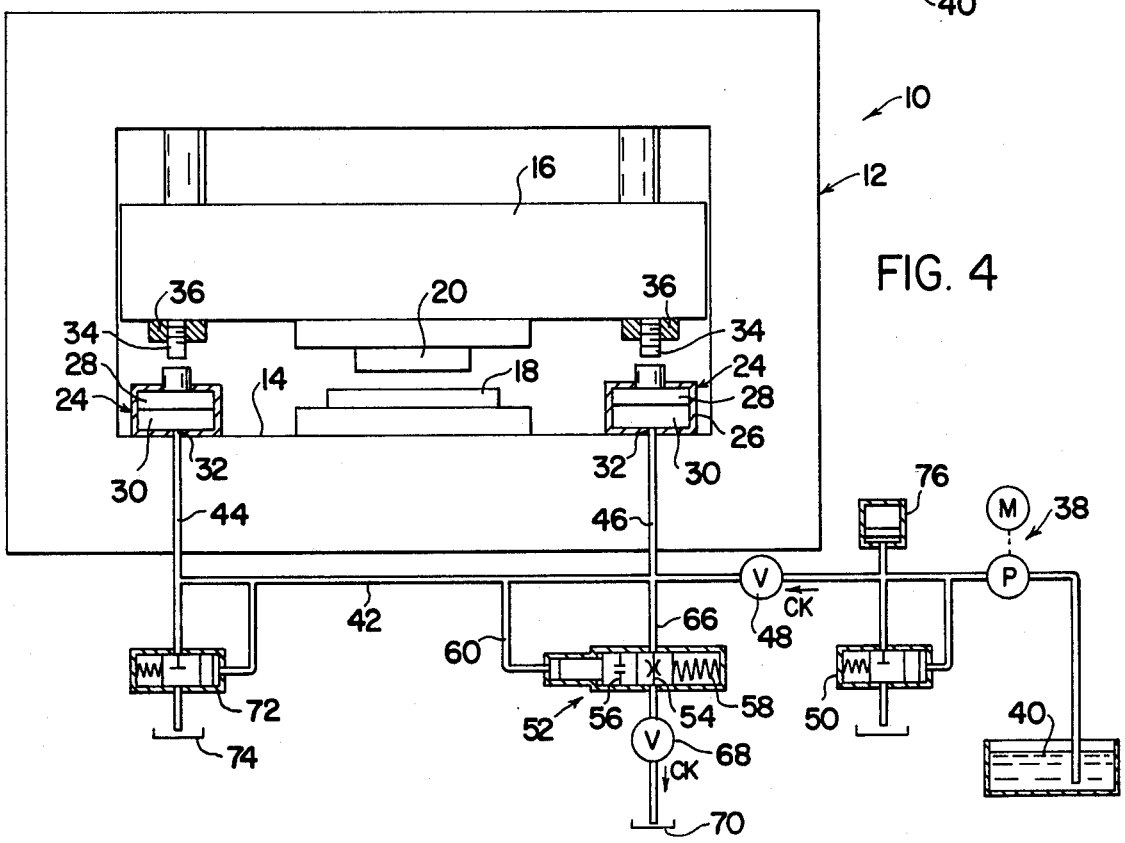
FIG. 4 is a schematic illustration of a modification of the system shown in FIG. 1.

The embodiment of the present invention illustrated in FIG. 4 is the same in many respects as that shown in FIG. 1 and, accordingly, like numerals are employed in FIGS. 1 and 4 to designate like components. In the embodiment of FIG. 4, restricted passageway 54 of shutoff valve 52 is in communication with source 40 and piston-cylinder units 24 through flow line 42 and a branch line 66 leading to the valve. Additionally, fluid flow through restricted passage 54 in response to downward movement of pistons 28 prior to material breakthrough is released by a low pressure check valve 68 for flow to a sump or the like 70 leading back to source 40. In further comparison of this embodiment with that shown in FIG. 1, high pressure accumulator 64 in FIG. 1 is replaced by a pressure responsive relief valve 72 which is operable in response to an undesirably high fluid pressure in the system to dump fluid to a sump or the like 74 for return to source 40. Further, low pressure accumulator 62 in FIG. 1 is replaced by a low pressure accumulator 76 positioned between motor-pump unit 38 and check valve 48 to accumulate fluid under pressure when shutoff valve 52 is closed to provide sufficient fluid for the system to return pistons 28 to their uppermost positions following a severing operation. It will be appreciated that accumulator 76 works in conjunction with motor-pump 38 in replenishing the system in this respect.

Operation of the system shown in FIG. 4 insofar as blocking fluid flow from chambers 30 of piston-cylinder units 24 is the same as that for the system shown in FIG. 1. In this respect, initial downward movement of pistons 28 prior to breakthrough is at the velocity of the press slide, whereby valve 52 remains open and fluid expelled from chambers 30 flows through check valve 68 to sump 70. Upon breakthrough, the sudden acceleration of slide 16 and the resulting velocity increase in the fluid flow closes valve 52 to block further flow of fluid from chambers 30 and thus stop downward displacement of the slide. When the slide reaches point 4 in the graph of FIG. 3, system pressure is reduced whereby valve 52 is biased open and pistons 28 are biased to their uppermost positions in preparation for the next severing operation.

It will be appreciated in conjunction with both of the embodiments herein disclosed that the magnitude of the load energy release at point 3 in the graph of FIG. 3 can be controlled toward minimization by using a minimum volume of hydraulic fluid in the piston-cylinder units and flow lines, by using a hydraulic fluid having a high bulk modulus, by using a rapid response flow sensitive shutoff valve, and by various combinations of these control possibilities.

In accordance with another aspect of the present invention, the component parts providing the variable volume chamber or chambers of the shock dampening system and a valve or the like controlling fluid flow from the chamber at the point of material breakthrough are structurally associated with a bolster plate or tooling so as to be removably mountable on the press bed as a unit with the bolster plate or tooling. Additionally, as will become apparent hereinafter, fluid pressure responsive relief components such as the high pressure and low pressure accumulators in the system illustrated in FIG. 1 can advantageously be mounted on the bolster plate or the component of the tooling assembly as a part of the structural unit removably mountable on the press bed. Accordingly, with reference to a shock dampening system similar to that illustrated in FIG. 1 for example, only the hydraulic fluid supply components as defined by motor-pump unit 38, source 40 and unloading valve 50 would be separate from the bolster plate or tooling components and would be readily connectable thereto when the structural unit is mounted on the press bed.

Figure 6:
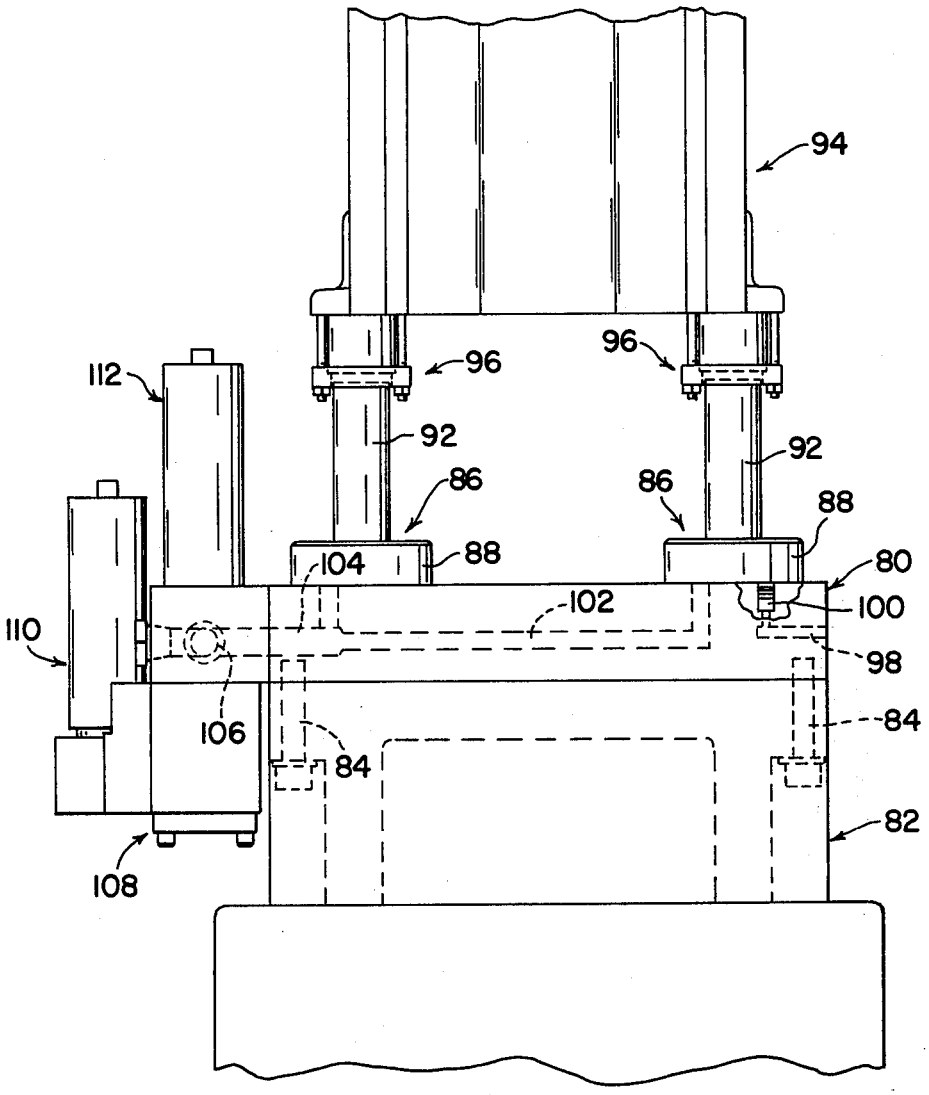
FIG. 6 is an end elevation view of a bolster plate and shock dampening system taken along line 6—6 in FIG. 5.
Figure 7:
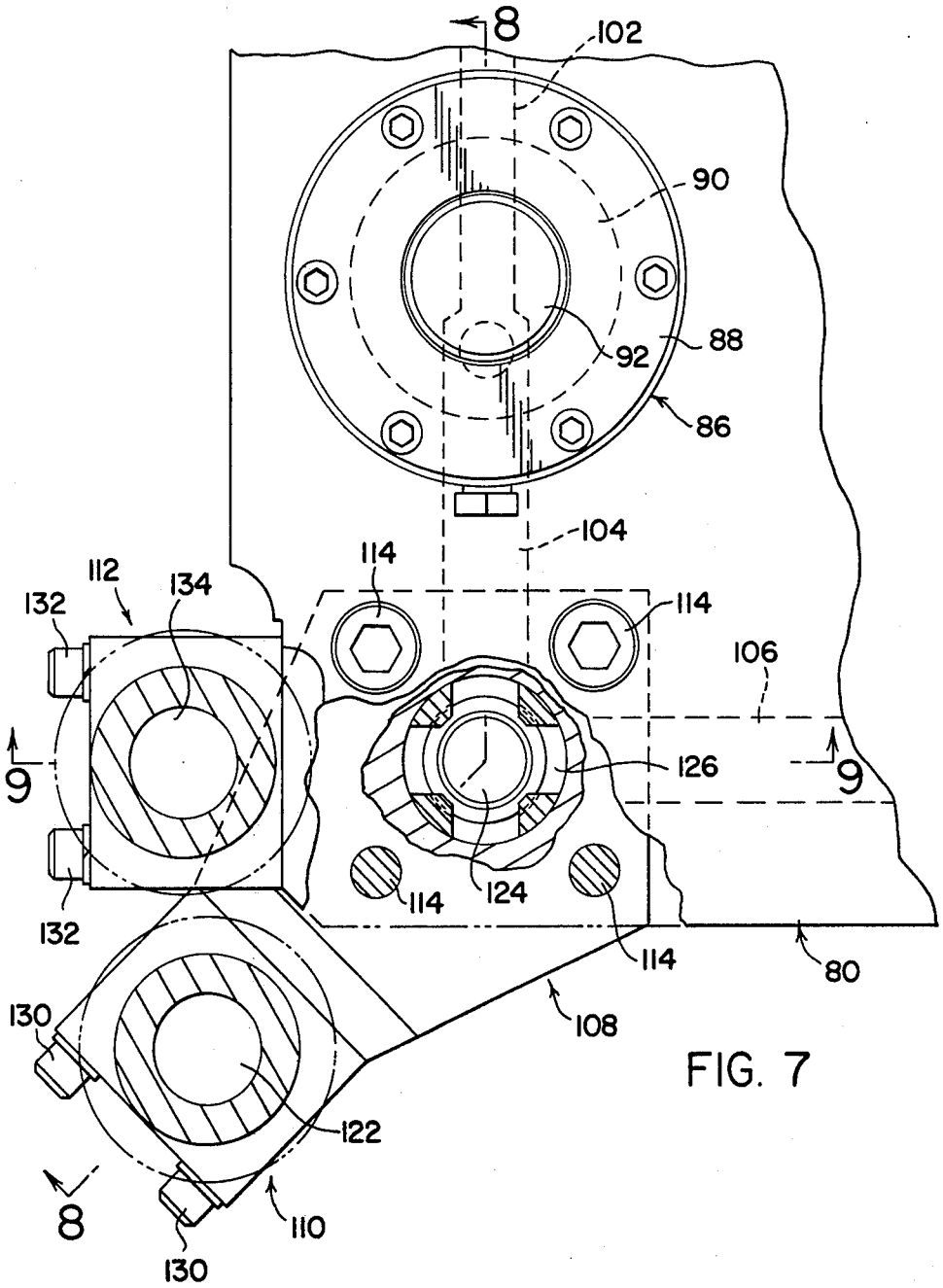
FIG. 7 is an enlarged detail plan view, partially in section, illustrating the structural association between a fluid receiving chamber, shutoff valve and accumulator components mounted on the bolster plate.
Figure 8:
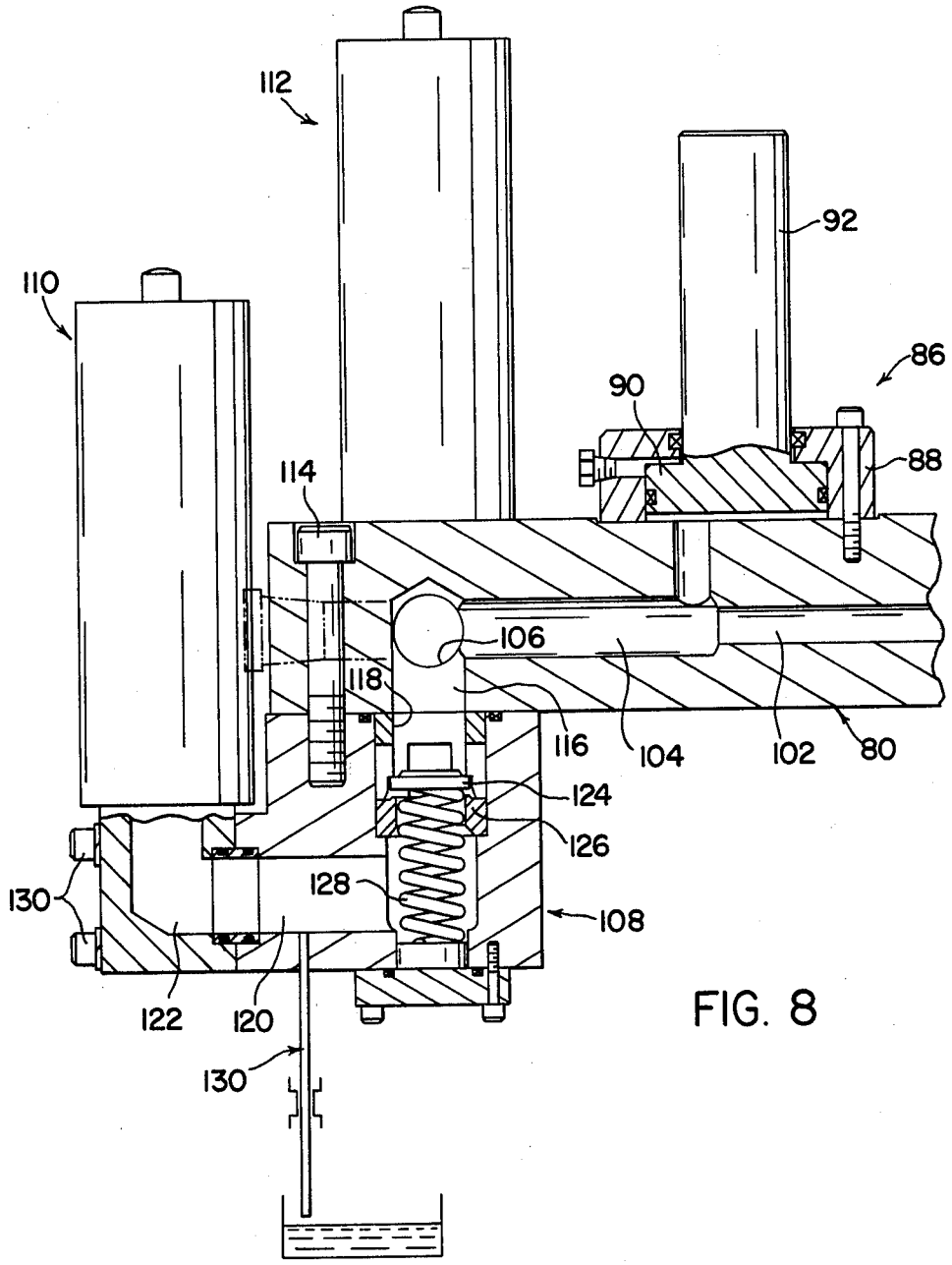
FIG. 8 is a sectional elevation view of the latter components taken along line 8—8 in FIG. 7.

A structural embodiment in which the component parts of the hydraulic shock dampening system are incorporated in a bolster plate is illustrated in FIGS. 5–9 of the drawing. With regard to the latter FIGURES, the bolster plate 80 is removably mounted on a press bed 82 by means of a plurality of bolts 84. In the embodiment shown, four variable volume fluid receiving chambers are provided by piston and cylinder assemblies 86 mounted on the upper surface of the bolster plate. As best seen in FIG. 8, each of the piston and cylinder assemblies 86 includes a cylinder member 88 bolted to the bolster plate and the piston member 90 reciprocably received therein and having a piston rod portion 92 extending vertically upwardly therefrom. The press slide 94 is provided with a plurality of actuators 96, each of which actuators is axially aligned with the corresponding one of the piston rods 92. It will be appreciated that each of the variable volume chambers is defined by the inner surface of cylinder 88 and the opposed surfaces of the bolster plate and piston 90, and that the piston is displaceable axially of the cylinder to vary the volume of the corresponding chamber.

Figure 5:
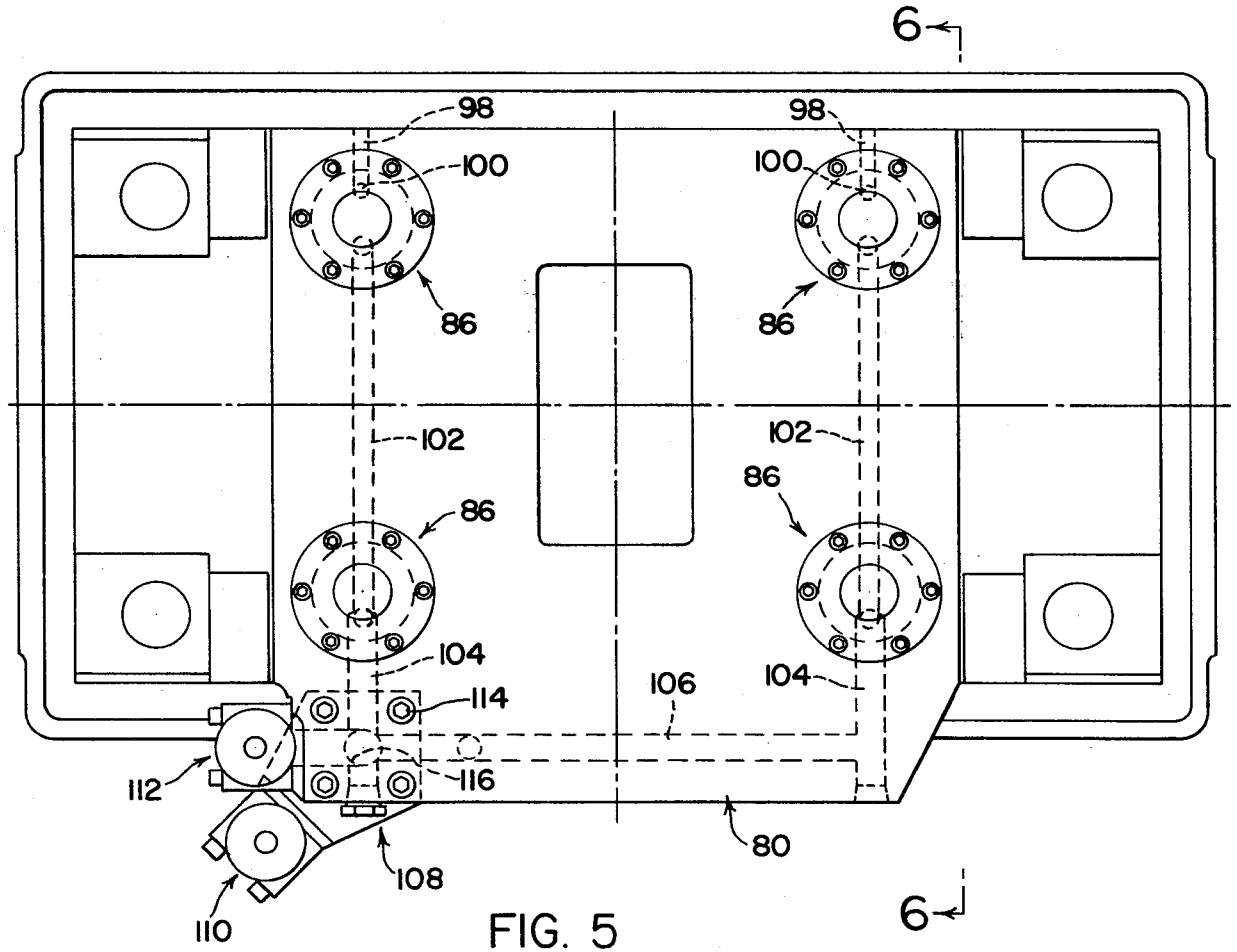
FIG. 5 is a plan view of a bolster plate having component parts of a shock dampening system mounted thereon for removal therewith as a unit from a press.

As viewed in FIGS. 5 and 6 of the drawing, the rear side of bolster plate 80 is provided with internal fluid receiving passageways 98 each opening into the corresponding one of the variable volume chambers adjacent the rear side of the bolster plate. Each of the passageways 98 is adapted to be connected to a source of hydraulic fluid under pressure, as set forth more fully hereinafter, and is provided with a corresponding check valve 100 to prevent fluid flow to passageway 98 from the corresponding fluid chamber. Bolster plate 80 is further provided with internal passageways 102 each connecting a rear fluid receiving chamber with the corresponding chamber disposed toward the front side of the bolster plate and with a corresponding passageway 104 which communicates with a common passageway 106 extending across the front side of the bolster plate.

In the embodiment shown, a shutoff valve assembly 108, a low pressure fluid accumulator 110 and a high pressure accumulator 112 are mounted on bolster plate 80 at the left hand front corner thereof and in fluid flow communication with corresponding portions of passageways 104 and 106 in the bolster plate. As best seen in FIGS. 7 and 8, shutoff valve assembly 108 is mounted on the bottom side of bolster plate 80 by means of a plurality of studs 114. Passageway 106 in the bolster plate and passageway 104 extending forwardly from the chamber assembly 86 adjacent the front left hand corner of the bolster plate intersect with one another and are in fluid flow communication with shutoff valve assembly 108 by means of a passageway 116 in the bolster plate and passageway 118 at the corresponding end of the valve assembly. The opposite end of the valve assembly includes a passageway 120 in fluid flow communication with passageway 122 opening into low pressure accumulator 110. In the embodiment shown, shutoff valve 108 includes a valve element 124 normally biased away from a valve seat 126 by means of a spring 128 to provide restricted flow of hydraulic fluid past the valve element in the direction toward accumulator 122 upon initial movement of pistons 90 of the variable volume chamber assemblies 86 toward the bolster plate and prior to material breakthrough during a shearing operation. Upon material breakthrough, the sudden acceleration of pistons 90 toward bolster plate 80 closes valve element 124 against seat 126 to prevent fluid flow therepast as explained hereinabove with regard to the system shown in FIGS. 1–4 of the drawing. While accumulator 110 is shown as being mounted on the housing of shutoff vavle 108 by means of a plurality of bolts 130, it will be appreciated that the accumulator could be direclty attached to the bolster plate as opposed to being mounted thereon through the valve assembly. As will be seen in FIG. 8, a small flow line 130 opens into passageway 120 of valve assembly 108 allowing a restricted flow of hydraulic fluid back to the hydraulic fluid source for the purpose set forth hereinafter.

Figure 9:
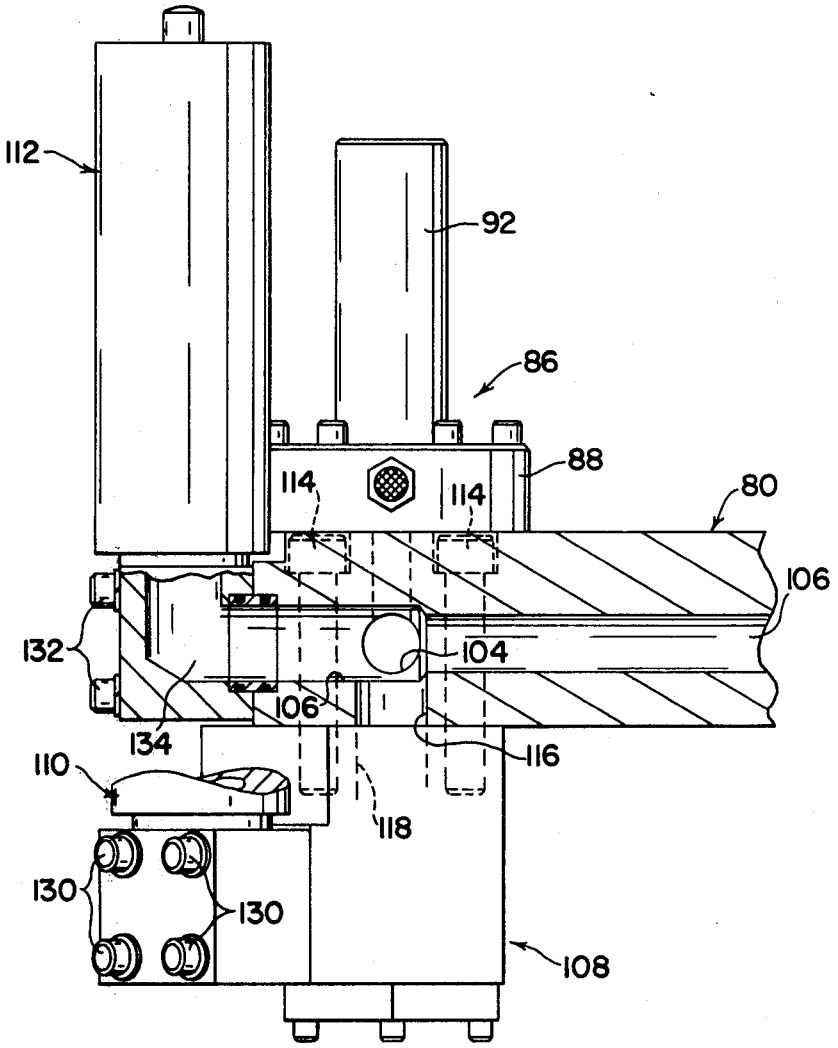
FIG. 9 is a sectional elevation view taken along line 9—9 in FIG. 7.

As best seen in FIGS. 7 and 9 of the drawing, high pressure accumulator 112 is mounted on the side of bolster plate 80 by means of a plurality of bolts 132 and includes a passageway 134 in flow communication with passageway 106 in the bolster plate. High pressure accumulator 112 serves the purpose set forth hereinabove with regard to accumulator 64 in the system illustrated in FIG. 1 of the drawing.

From the foregoing description of FIGS. 5–9, it will be appreciated that the inlet ends of fluid flow passageways 98 in the rear side of bolster plate 80 are adapted to be connected to flow lines from a source of hydraulic fluid under pressure such as that defined by motor-pump unit 38, source 40 and unloading valve 50 in the system shown in FIG. 1 of the drawing. It will be further appreciated that fluid flow from such a source enters the rear chamber assemblies 86 through the corresponding check valves 100 and into the remainder of the component parts of the shock dampening system mounted on bolster plate 80 by means of passageways 102, 104, 106 and 116 in the bolster plate, and to accumulator 110 through assembly 108 and passageways 120 and 122. At the beginning of a shearing operation, pistons 90 are displaced downwardly as a result of the engagement of actuators 96 on the press slide with piston rods 92, check valves 100 prevent fluid flow back toward the source through passages 98, and spring 128 in shutoff valve assembly 108 permits restricted fluid flow to low pressure accumulator 110 prior to breakthrough of the material being severed. Upon breakthrough and the resulting acceleration of the press slide, the hydraulic fluid under pressure closes valve element 124 against seat 126 to dampen the shock resulting from such slide acceleration. Upon the ensuing upward movement of the press slide, the fluid under pressure in accumulator 110 flows back through valve assembly 108 to re-load the variable volume chamber assemblies for the next shearing operation. As explained in connection with the system shown in FIG. 1 of the drawing, high pressure accumulator 112 is a safety mechanism operable in response to an overload on the press which would impose an abnormally high pressure on the hydraulic system. In connection with such a shock dampening system, it may be desirable to provide for cooling the system fluid, and the restricted fluid flow from passage 120 of valve assembly 108 through line 130 shown in FIG. 8 advantageously allows a small amount of the system fluid to be so circulated through a cooling unit, not shown, and back to the fluid source. In the event the recirculation is desired for this purpose, it will be appreciated that the bolster plate and the hydraulic system components mounted thereon can readily be attached to the press bed, whereafter it is only necessary to connect supply lines from the source to the inlet ends of passages 98 and the return line to passage 120 of the shutoff valve assembly. Likewise, when it is desired to dismount the bolster plate from the press, it is only necessary to disconnect the hydraulic fluid flow lines from the bolster plate unit and then remove the bolster plate from the press bed.

Figure 10:
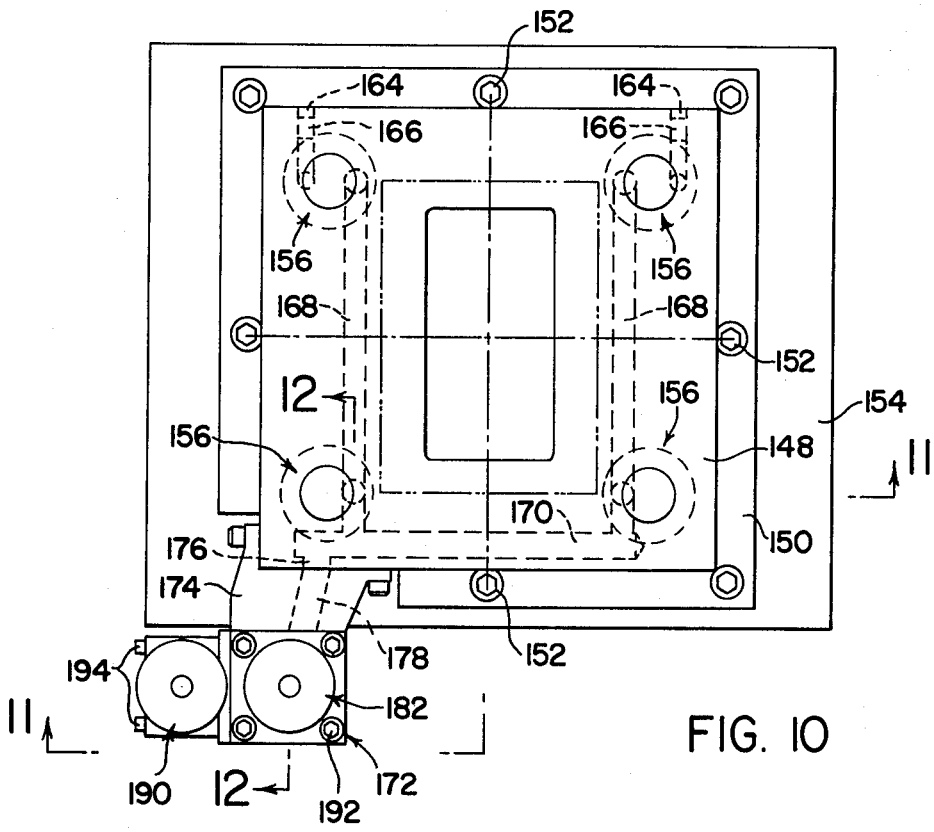
FIG. 10 is a plan view illustrating component parts of a shock dampening system structurally associated with a cutting die assembly removably mounted on a press bed.
Figure 11:
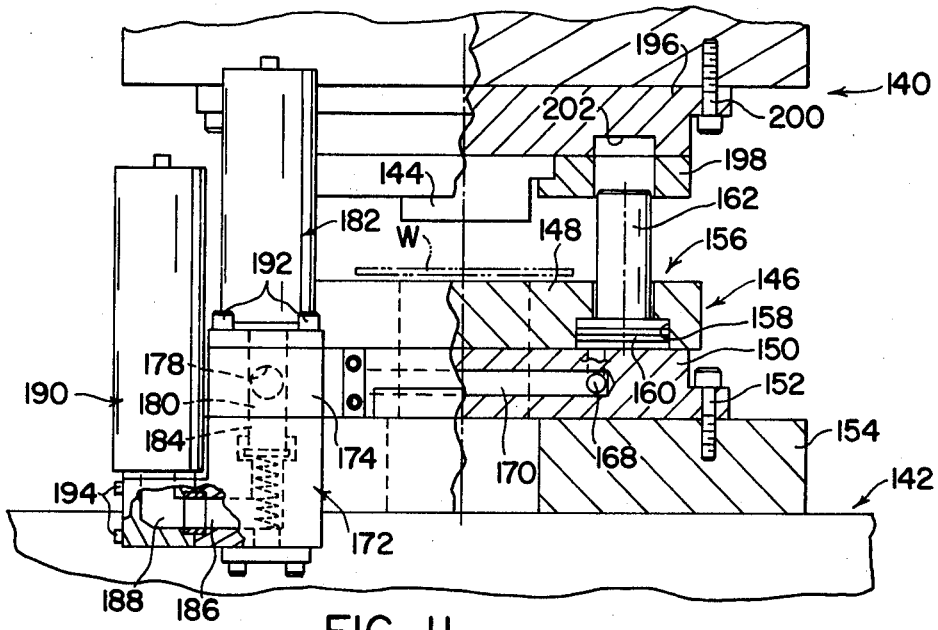
FIG. 11 is an elevation view, partially in section, taken along line 11—11 in FIG. 10.
Figure 12:
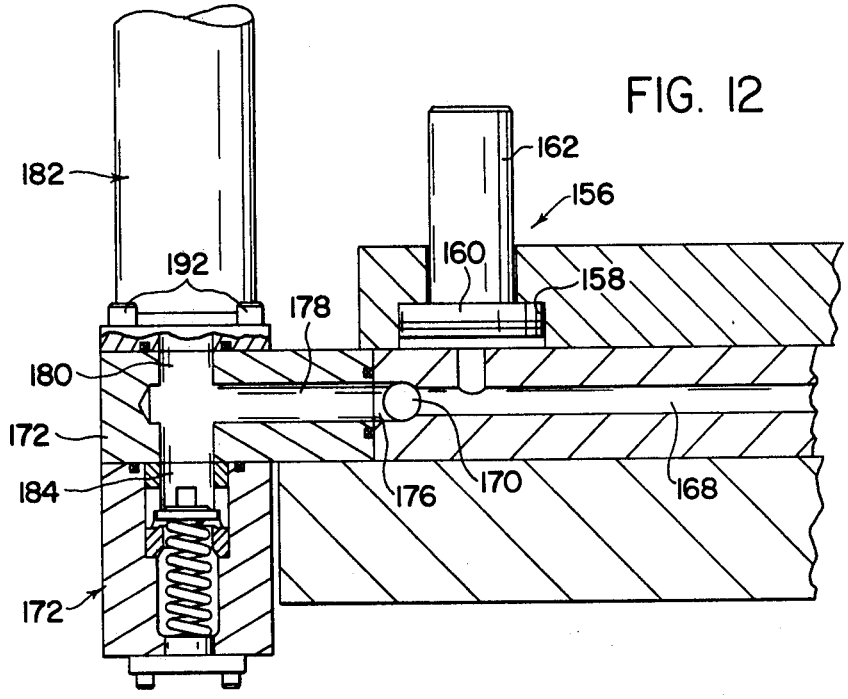
FIG. 12 is a sectional elevation view taken along line 12—12 in FIG. 10.

In accordance with another aspect of the present invention, the major components of shock dampening system for a shearing press can be structurally incorporated in tooling supported by the press bed so as to be removable as a unit with the tooling, thus facilitating interchangeability of the assembly with espect to different presses as well as maintenance or replacement functions with regard to both the tooling and the hydraulic system components. One embodiment of such a structural arrangement is illustrated in FIGS. 10–12 of the drawing. In this respect, the press slide 140 and press bed 142 support cooperable shearing components including a punch member 144 on the slide and a cutting die assembly 146 on the press bed. In the embodiment shown, the cutting die assembly includes a cutting die member 148 and a die shoe plate member 150 disposed therebeneath and to which the cutter member 148 is suitably attached. Cutting die assembly 146 is adapted to be removably mounted in the press and, in the embodiment shown, such removable mounting is achieved by means of a plurality of bolts 152 connecting die shoe member 150 with a bolster plate 154 supported on the press bed. Cutting die assembly 146 is provided with a plurality of variable volume fluid receiving chamber assemblies 156 each defined by a cylinder 158 provided in the underside of cutting die member 148 and an axially reciprocable piston 160 disposed in the cylinder and provided with a piston rod 162 extending upwardly therefrom through a corresponding opening in the cutting die member. Each variable volume chamber is of course defined by the cylinder and the opposed surfaces of the piston and die shoe member 150.

The rear side of die shoe member 150 is provided with fluid receiving passageways 164, each of which is adapted to be connected to a source of hydraulic fluid under pressure and opens into a corresponding one of the chambers adjacent the rear side of the die shoe member. Further, each passageway 164 is provided with a corresponding check valve 166 which prevents fluid flow from the corresponding chamber back through passageway 164. Die shoe member 150 is further provided with internal passageways 168 communicating the rear chambers with the corresponding one of the chambers adjacent the front side of the die shoe member and with a common fluid passageway 170 in the die shoe member adjacent the front end thereof.

A shutoff valve assembly 172 similar to valve assembly 108 described hereinabove in conjunction with FIG. 8 is mounted on die shoe member 150 adjacent one corner of the die shoe member by means of a mounting block 174 bolted to the die shoe member. The latter corner of the die shoe is provided with a passageway 176 communicating with passageway 170 and opening into passageway 178 in mounting block 174. Mounting block 174 is further provided with a vertical passageway 180 intersecting passageway 178 and having an upper end opening into a high pressure accumulator 182 and a lower end opening into passage 184 of valve assembly 172. The other end of valve assembly 172 includes a passageway 186 communicating with a passageway 188 opening into a low pressure accumulator 190. High pressure accumulator 182 is mounted on mounting block 174 by means of a plurality of bolts 192, and low pressure accumulator 190 is mounted on the housing of valve assembly 172 by means of a plurality of bolts 194.

In the embodiment shown, punch member 144 is mounted on the press slide by means of a corresponding die shoe member 196 on which the punch is retained by means of a punch holder 198 bolted thereto and which die shoe member is removably mounted on the press slide by means of a plurality of bolts 200. Die shoe member 196 and punch holder 198 are recessed to provide an actuating surface 202 for each of the piston rods 162 and by which the corresponding piston is displaced downwardly toward die shoe member 150 during a shearing operation.

It will be appreciated from the foregoing description that passageways 164 are adapted to be connected to a source of hydraulic fluid under pressure and that check valves 166 prevent the back flow of fluid toward such source during operation of the shock dampening system. It will be further appreciated that actuating surfaces 202 engage piston rods 162 when punch 144 engages a workpiece W disposed therebeneath, whereby pistons 160 are displaced toward die shoe member 150 during the shearing operation, shutoff valve assembly 172 permitting restricted flow of fluid to low pressure accumulator 190 during the shearing operation and prior to material breakthrough. Upon material breakthrough and the resulting accelerated movement of slide 140, valve assembly 172 is actuated to block fluid flow therethrough thus to dampen slide movement at the point of breakthrough. When it is desired to remove the tooling assembly from the press for maintenance or replacement purposes or for associating the tool assembly with another press, it is only necessary to disconnect the hydraulic fluid lines from passageways 164 and remove the bolts 152 mounting the cutting die assembly 146 on the bolster plate. The cutting die assembly 146 together with the component parts of the hydraulic system mounted thereon are then removable as a unit from the press. Additionally, it will be appreciated that, if desired, the upper die assembly can be released from slide 140 by removing bolts 200 and the upper die assembly lowered onto the lower die assembly for removal therewith from the press.

Figure 13:
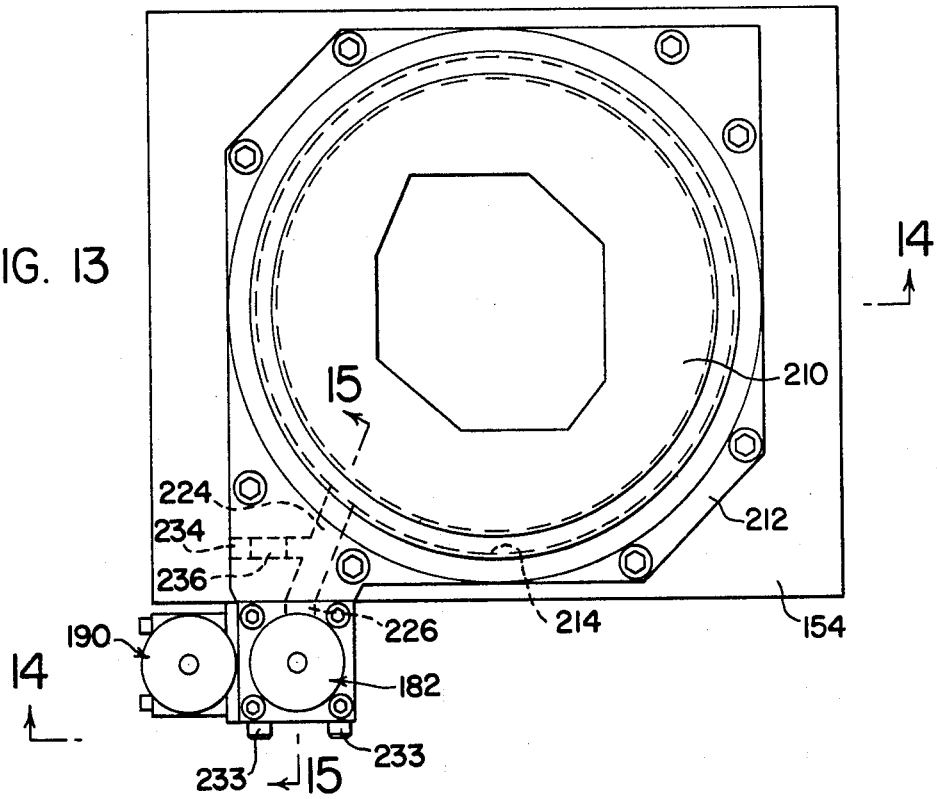
FIG. 13 is a plan view of another embodiment in which the component parts of a shock dampening system are structurally incorporated in a cutting die assembly.
Figure 14:
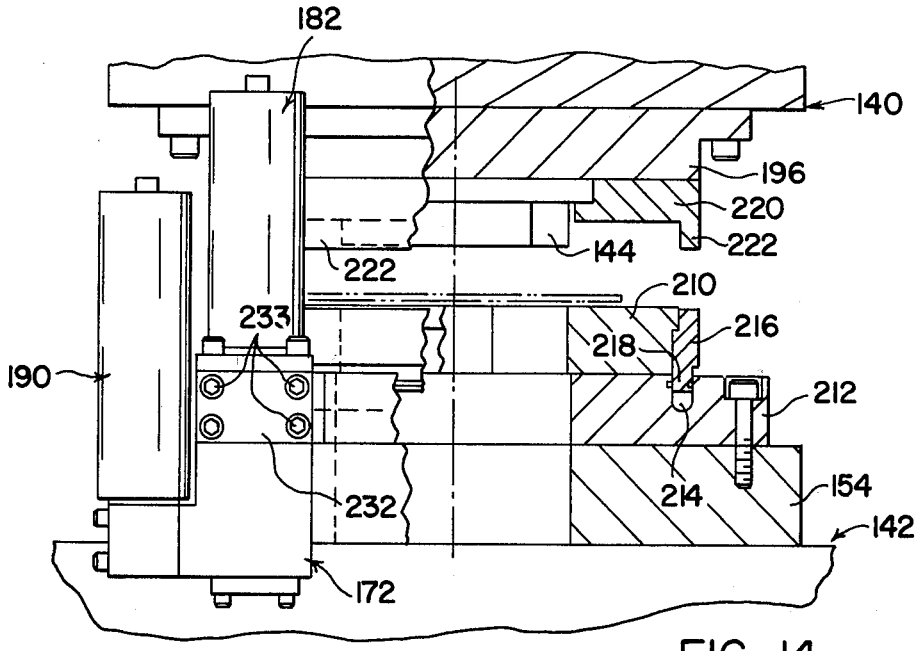
FIG. 14 is a elevation view, partially in section, taken along line 14—14 in FIG. 13.
Figure 15:
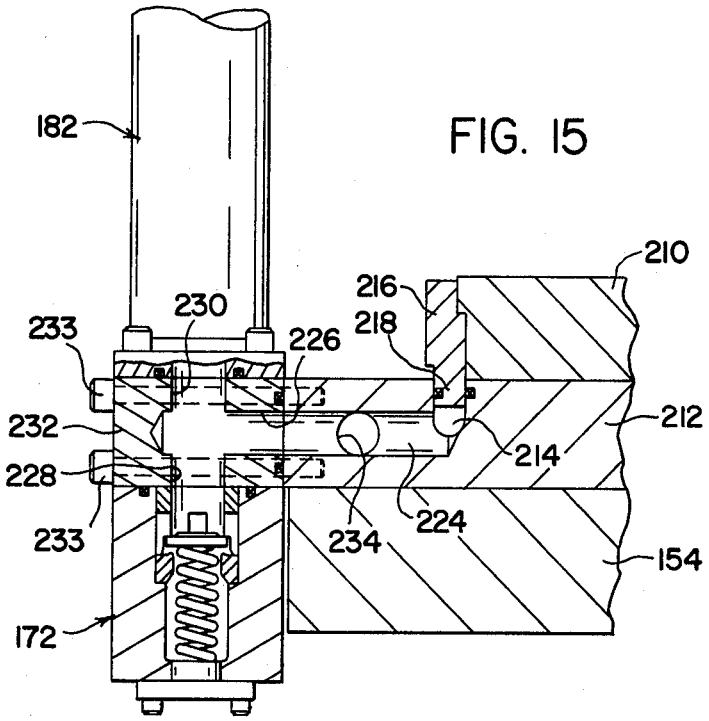
FIG. 15 is an elevation view, in section, taken along line 15—15 in FIG. 13.

A further embodiment in which the major component parts of a shock dampening system are incorporated with tooling for a press is illustrated in FIGS. 13–15 of the drawing. The embodiment illustrated in FIGS. 13–15 is similar in many respects to that illustrated in FIGS. 10–12 and, accordingly, like reference numerals are employed to indicate corresponding components in the two embodiments. In the embodiment shown in FIGS. 13–15, the lower die assembly includes a cutting die member 210 attached to a die shoe member 212 which is removably mounted on bolster plate 154. The variable volume fluid receiving chamber is defined by an annular recess 214 opening axially into die shoe member 212 and an annular member 216 surrounding cutting die member 210 and having a lower annular piston portion 218 reciprocably received in recess 214. Punch member 144 is mounted on slide 140 by means of a die shoe member 196 and a punch holder member 220 which is provided with an annular actuating portion 222 vertically aligned with the upper end of annular member 216. Accordingly, upon downward movement of slide 140 actuator 122 engages annular member 216 to displace piston portion 218 thereof downwardly to reduce the volume of the fluid receiving chamber.

Lower die shoe member 212 is provided with an internal passageway 224 opening into recess 214 thus to communicate the variable volume chamber with passageways 226, 228 and 230 in a mounting block 232 mounted on die shoe member 212 by means of a plurality of bolts 234. Shutoff valve assembly 172 is mounted on the underside of mounting block 232 in flow communication with passageway 228, and low pressure accumulator 190 is mounted on the housing of valve assembly 172 in flow communication with the corresponding end of the passageway through the valve assembly. High pressure accumulator 182 is mounted on the upper side of mounting block 232 in flow communication with passageway 230. Die shoe member 212 is further provided with a passageway 234 adapted to be connected to a source of hydraulic fluid under pressure and opening into passageway 224. A check valve 236 is provided in passageway 234 to prevent fluid flow therethrough in the direction toward the fluid source. Accordingly, it will be appreciated that during a shearing operation actuating portion 222 of the punch holder engages annular member 216 displacing the latter downwardly and that valve assembly 172 provides restricted fluid flow from the annular variable volume chamber to accumulator 190 up to the point of material breakthrough. Upon material breakthrough and the resulting accelerated movement of slide 140 valve assembly 172 is actuated to block further fluid flow thereacross. It will be further appreciated that the tooling assembly is readily removable from the press by disconnecting the fluid supply line to passageway 234 and removing the bolts by which die shoe member 212 is fastened to the bolster plate, and that the upper die assembly can be released from the slide and supported on the lower die assembly, whereby the entire tooling package together with the hydraulic circuit components mounted on the lower die shoe can be removed as a unit from the press.

While considerable emphasis has been placed on the specific embodiments herein illustrated and described, it will be readily understood that many modifications will be obvious and suggested upon reading the foregoing description and can be made without departing from the principles of the present invention. In this respect, for example, it will be appreciated that variable volume devices other than piston-cylinder units can be employed and that, in connection with piston-cylinder units, the piston-cylinder relationship can be reversed so that the cylinder is a movable component engaged by the press. Still further, while it is preferred to employ a flow sensitive shutoff valve permitting restricted fluid flow therethrough prior to breakthrough of the material being severed, it will be appreciated that other shutoff valve structures could be employed. Moreover, it will be appreciated that the shutoff valve could be controlled other than by system fluid. For example, the valve could be solenoid actuated to close at the point of breakthrough. It is only necessary in accordance with this aspect of the present invention that the shutoff valve be catuated at the point of acceleration of the slide upon breakthrough to positively block fluid flow from the chambers of the variable volume devices. Additionally, while it is preferred to employ the shutoff valve feature in conjunction with systems in which the major components are structurally incorporated with a bolster plate and/or press tooling, it will be appreciated that the attributes of such structural arrangements are obtainable independently of the specific flow control valve. In this respect, it will be appreciated, for example, that a valve providing restricted flow thereacross in response to material breakthrough could readily be substituted for the positive shutoff valve disclosed herein without effecting removability of the bolster plate or tooling.

As many possible embodiments of the present invention may be made and as many changes may be made in the embodiments herein illustrated and described, it is to be distinctly understood that the foregoing descriptive matter is to be interpreted merely as illustrative of the present invention and not as a limitation.

Having thus described the invention, it is claimed:

1. In a hydraulic shock dampening system for a shearing press having frame means including bed means and supporting reciprocable slide means and wherein material is severed between cooperable shearing means supported by said bed and slide means, said system including hydraulic fluid receiving variable volume chamber means between said bed means and slide means and connected to a source of hydraulic fluid under pressure, said chamber means being operable under compression in response to breakthrough of material being sheared by said shearing means supported by said slide means to restrain the resulting accelerated movement of said slide means, the improvement comprising: shutoff valve means in fluid flow communication with said chamber means, said valve means having opened and closed modes, and means completely closing said valve means in response to said accelerated movement of the press slide to prevent any fluid flow from said chamber means.

2. The improvement according to claim 1, wherein said valve means includes restricted passageway means in communication with said chamber means when said valve means is in said open mode to permit restricted fluid flow from said chamber means prior to said accelerated slide movement.

3. The improvement according to claim 1, wherein said valve means is fluid flow responsive and said means closing said valve means is fluid flowing from said chamber means.

4. The improvement according to claim 3, wherein said valve means includes restricted passageway means in connunication with said chamber means when said valve means is in said open mode to permit restricted fluid flow from said chamber means prior to said accelerated slide movement.

5. The improvement according to claim 3, wherein said valve means is in fluid flow line means from said source to said chamber means, and fluid pressure relief means in said fluid flow line means between said valve means and chamber means.

6. The improvement according to claim 5, wherein said relief means is fluid pressure responsive relief valve means.

7. The improvement according to claim 5, wherein said relief means is fluid pressure responsive accumulator means.

8. The improvement according to claim 1, and bolster plate means removably mountable on said bed means, said chamber means and said shutoff valve means being mounted on said bolster plate means for removal therewith from said bed means.

9. The improvement according to claim 8, and fluid pressure responsive accumulator means mounted on said bolster plate means and in fluid flow communication with said chamber means and said shutoff valve means.

10. The improvement according to claim 9, wherein said bolster plate means includes fluid flow passageway means therein providing said fluid flow communication between said chamber means, shutoff valve means and accumulator means.

11. The improvement according to claim 10, and second passageway means in said bolster plate means for directing hydraulic fluid from said source to said chamber means, and check valve means in said second passageway means to prevent fluid flow therethrough from said chamber means.

12. The improvement according to claim 1, wherein said shearing means supported by said bed means is removably mountable thereon, said variable volume chamber means and said shutoff valve means being on said removably mountable shearing means.

13. The improvement according to claim 12, wherein said removably mountable shearing means includes a cutting die assembly including a cutting die member and a die mounting member, said variable volume chamber means including means providing a cylinder in one of said cutting and mounting members and piston means in said cylinder.

14. The improvement according to claim 13, wherein said shutoff valve means is mounted on said die mounting member, and passageway means in said die mounting member communicating said cylinder with said valve means.

15. The improvement according to claim 14, and fluid pressure responsive accumulator means supported on said die mounting member and in fluid communication with said cylinder and said shutoff valve means.

16. The improvement according to claim 14, wherein said cylinder is in said cutting die member.

17. The improvement according to claim 14, wherein said cylinder is in said die mounting member.

18. A hydraulic shock dampening system for a shearing press having frame means including bed means and supporting reciprocable slide means and wherein material is severed between cooperable shearing means supported by said bed and slide means, comprising variable volume chamber means between said slide means and frame means and including means displaceable to reduce the volume of said chamber means during movement of said slide means toward said bed means to sever material between said shearing means, a source of hydraulic fluid, means to deliver hydraulic fluid from said source to said chamber means under pressure, movement of said slide means being accelerated in the direction of said bed means when said shearing means supported by said slide means breaks through the material being severed, said accelerated slide movement accelerating said displaceable means, and fluid flow actuated shutoff valve means in fluid flow communication with said chamber means and actuated to close in response to acceleration of said displaceable means to prevent any fluid flow from said chamber means.

19. The shock dampening system according to claim 18, wherein said shutoff valve means includes flow restriction means permitting restricted fluid flow from said chamber means prior to said acceleration of said displaceable means.

20. The shock dampening system according to claim 18, wherein said means to deliver hydraulic fluid from said source includes flow line means connected to said chamber means, and pressure overload relief means in said flow line means between said source and said chamber means.

21. The shock dampening system according to claim 20, wherein said overload relief means is pressure responsive relief valve means.

22. The shock dampening system according to claim 20, wherein said overload relief means is pressure responsive accumulator means.

23. The shock dampening system according to claim 18, wherein said variable volume chamber means includes cylinder means on said press bed and piston means reciprocable therein and defining said displaceable means.

24. The shock dampening system according to claim 23, wherein said cylinder means includes common inlet and outlet passage means opening thereinto behind said piston means and said means to deliver hydraulic fluid from said source includes flow line means connected to said common passage means, check valve means in said flow line means preventing backflow toward said source, and fluid pressure actuated overload relief means in said flow line means between said check valve means and said passage means.

25. The shock dampening system according to claim 24, wherein said shutoff valve means includes flow restriction means in fluid flow communication with said flow line means between said check valve means and said passage means, said flow restriction means permitting restricted fluid flow from said chamber means prior to said acceleration of said displaceable means.

26. The shock dampening system according to claim 25, and fluid pressure responsive accumulator means in said flow line means between said shutoff valve means and said check valve means, said accumulator means receiving fluid under pressure in response to flow from said chamber means prior to said acceleration of said displaceable means, said accumulator means being responsive to a pressure less than that of said overload relief means.

27. The shock dampening system according to claim 26, wherein said overload relief means is second fluid pressure responsive accumulator means.

28. The shock dampening system according to claim 18, and a bolster plate removably mountable on said bed means, said chamber means including a cylinder member mounted on said bolster plate and cooperable therewith to define a piston chamber, said displaceable means including piston means in said piston chamber, said shutoff valve means being mounted on said bolster plate, and said bolster plate including passageway means therein providing said fluid flow communication between said chamber means and shutoff valve means.

29. The shock dampening system according to claim 28, and fluid pressure responsive accumulator means mounted on said bolster plate means, said passageway means in said bolster plate providing fluid flow communication between said chamber means and said accumulator means.

30. The shock dampening system according to claim 29, wherein said bolster plate includes second passageway means for directing hydraulic fluid from said source to said chamber means, and check valve means in said second passageway means to prevent fluid flow therethrough from said chamber means.

31. The shock dampening system according to claim 18, wherein said shearing means supported by said bed means is removably mountable thereon, said variable volume chamber means and said shutoff means being on said removably mountable shearing means.

32. The shock dampening system according to claim 31, wherein said removably mountable shearing means includes a cutting die assembly including a cutting die member and a die mounting member, said variable volume chamber means including means providing a cylinder in one of said cutting and mounting members and piston means in said cylinder and defining said displaceable means.

33. The shock dampening system according to claim 32, wherein said shutoff valve means is mounted on said die mounting member, and passageway means in said die mounting member communicating said cylinder with said valve means.

34. The shock dampening system according to claim 33, wherein said cylinder is in said cutting die member.

35. The shock dampening system according to claim 34, and fluid pressure responsive accumulator means supported on said die mounting member and in fluid communication with said cylinder and said shutoff valve means.

36. The shock dampening system according to claim 33, wherein said cylinder is in said die mounting member.

37. The shock dampening system according to claim 36, and fluid pressure responsive accumulator means supported on said die mounting member and in fluid communication with said cylinder and said shutoff valve means.

38. In a hydraulic shock dampening system for a shearing press having frame means including bed means and supporting reciprocable slide means and wherein material is severed between cooperable shearing means supported by said bed and slide means, said shearing means supported by said bed means including shearing member means and shearing member support means, said system including hydraulic fluid receiving variable volume chamber means between said bed means and slide means and connected to a source of hydraulic fluid under pressure, said variable volume chamber means including cylinder means and displaceable piston means in said cylinder means, said chamber means being operable under compression in response to breakthrough of material being sheared by said shearing means supported by said slide means to restrain the accelerated movement of said slide means, and flow control means operable to control fluid flow from said chamber means, the improvement comprising: one of said shearing member means and said shearing member support means including means providing said cylinder means, said flow control means being mounted on said shearing member support means, and said shearing member support means including fluid flow passageway means therein connectable to said source of hydraulic fluid and connecting said cylinder means and said flow control means in fluid flow communication.

39. The improvement according to claim 38, wherein said flow control means includes valve means having opposite ends with respect to fluid flow therethrough, one of said ends being in flow communication with said passageway means, and fluid pressure relief means mounted on said valve means in flow communication with the other of said ends.

40. The improvement according to claim 39, wherein said relief means is fluid pressure responsive accumulator means.

41. The improvement according to claim 40, wherein second accumulator means is mounted on said shearing member support means in flow communication with said passageway means.

42. The improvement according to claim 41, wherein said shearing member means is said one of said shearing member means and said shearing member support means.

43. The improvement according to claim 41, wherein said shearing member support means is said one of said shearing member means and said shearing member support means.

44. The improvement according to claim 38, wherein said shearing member means is said one of said shearing member means and said shearing member suport means.

45. The improvement according to claim 38, wherein said shearing member support means is said one of said shearing member means and said shearing member support means.

46. The improvement according to claim 38, wherein said shearing member support means includes bolster plate means, said cylinder means being on said bolster plate means, said flow control means being valve means mounted on said bolster plate means, and said fluid flow passageway means being in said bolster plate means.

47. The improvement according to claim 46, and fluid pressure responsive accumulator means mounted on said valve means in fluid flow communication therewith, said valve means being between said passageway means and said accumulator means.

48. The improvement according to claim 47, and second accumulator means mounted on said bolster plate means in fluid flow communication with said passageway means.

49. The improvement according to claim 46, wherein said fluid flow passageway means includes first passageway means connectable to said source of hydraulic fluid and opening into said cylinder means and second passageway means between said cylinder means and said valve means.

50. The improvement according to claim 49, and a check valve in said first passageway means to prevent flow from said cylinder means toward said source.

51. The improvement according to claim 50, wherein said flow control valve means has opposite ends with respect to fluid flow therethrough, one of said ends being in fluid flow communication with said second passageway means, and fluid pressure responsive accumulator means mounted on said valve means in fluid flow communication with the other of said ends.

52. The improvement according to claim 51, and second accumulator means mounted on said bolster plate means in fluid flow communication with said second passageway means.

53. The improvement according to claim 38, wherein said shearing member support means includes die shoe member means underlying said shearing member means, said flow control means being valve means mounted on said die shoe member means, said fluid flow passageway means being in said die shoe member means, and said cylinder means being in said shearing member means.

54. The improvement according to claim 53, wherein said passageway means includes first and second passageway means, said first passageway means having an inlet connectable to said source of hydraulic fluid and an outlet opening into said cylinder means, said second passageway means opening into said cylinder means and connecting said cylinder means and said valve means.

55. The improvement according to claim 54, and check valve means mounted in said first passageway means to prevent flow from said cylinder means through said first passageway means.

56. The improvement according to claim 55, and fluid pressure relief means mounted on said die shoe member means in fluid flow communication with said second passageway means.

57. The improvement according to claim 56, wherein said relief means is fluid pressure responsive accumulator means.

58. The improvement according to claim 55, wherein said flow control valve means has opposite ends with respect to fluid flow therethrough, one of said ends being in fluid flow communication with said second passageway means, and fluid pressure responsive accumulator means mounted on said valve means in fluid flow communication with the other of said ends.

59. The improvement according to claim 58, and second accumulator means mounted on said bolster plate means in fluid flow communication with said second passageway means.

60. The improvement according to claim 38, wherein said shearing member support means includes die shoe member means underlying said shearing member means, and flow control means being mounted on said die shoe member means, said cylinder means being in said die shoe member means, and said fluid flow passageway means being in said die shoe member means.

61. The improvement according to claim 60, wherein said passageway means includes fluid flow inlet passageway means connectable to said source of hydraulic fluid, and check valve means in said inlet passageway means to prevent flow therethrough toward said source.

62. The improvement accordng to claim 60, and fluid pressure relief means mounted on said die shoe member means in fluid flow communication with said passageway means.

63. The improvement according to claim 62, wherein said relief means is fluid pressure responsive to accumulator means.

64. The improvement according to claim 60, wherein said flow control means includes valve means having opposite ends with respect to fluid flow therethrough, one of said ends being in flow communication with said passageway means, and fluid pressure relief means mounted on said valve means in flow communication with the other of said ends.

65. The improvement according to claim 64, wherein said relief means is fluid pressure responsive accumulator means.

66. The improvement according to claim 63, and second accumulator means mounted on said die shoe member means in flow communication with said passageway means.

67. The improvement according to claim 66, wherein said passageway means includes fluid flow inlet passageway means connectable to said source of hydraulic fluid, and check valve means in said inlet passageway means to prevent flow therethrough toward said source.

68. The improvement according to claim 60, wherein said cylinder means in an annular recess in said die shoe member means, and said piston means is an annular piston member including a portion surrounding said shearing member means.

* * * * *